United States Patent [19]

Mason

[11] Patent Number: 4,885,805

[45] Date of Patent: Dec. 12, 1989

[54] APPAREL WITH CARRIERS FOR NECK-WEAR

[75] Inventor: Billie M. Mason, Glencoe, Ill.

[73] Assignee: Wild West Artwear, Inc., Glencoe, Ill.

[21] Appl. No.: 259,248

[22] Filed: Oct. 18, 1988

[51] Int. Cl.[4] ..... A41D 27/08

[52] U.S. Cl. ..... 2/244; 2/115; 2/106; 2/243 B; 2/246; 2/271

[58] Field of Search ..... 2/49 R, 49 A, 74, 75, 2/80, 105, 106, 113, 114, 244, 246, 271, 243 B, 115; 446/26, 28

[56] References Cited

U.S. PATENT DOCUMENTS

| | | | |
|---|---|---|---|
| 528,536 | 11/1894 | Feldheimer | 2/113 |
| 1,077,188 | 10/1913 | Condit | 2/113 |
| 1,119,399 | 12/1914 | Burkland | 2/113 |
| 1,139,652 | 5/1915 | Emmers | 2/113 |
| 1,459,747 | 6/1923 | Redmond | 2/113 |
| 1,524,491 | 1/1925 | Sprenger | 2/113 |
| 2,750,595 | 6/1956 | Hollinger | 2/113 |
| 2,903,703 | 9/1959 | Blish | 2/137 |
| 4,599,750 | 7/1986 | Rahaman | 2/243 R |

OTHER PUBLICATIONS

Maroon, F. J., Keepers of the Sea, Naval Institute Press, Annapolis, MD, 1983. Pertinent page is p. 192.

*Primary Examiner*—Werner H. Schroeder
*Assistant Examiner*—Jeanette E. Chapman
*Attorney, Agent, or Firm*—Walter C. Ramm

[57] ABSTRACT

A article of plant body apparel with a neckband circumscribing a neck opening (through which the wearer passes his/her head and neck) and with several loops comprising carriers or carrier-elements attached to the article. The carriers are spaced slightly outwardly from the neckband, and also from each other, to define a course circumferential of the neckband, and are adapted to receive and carry a selected item of elongate neckwear, such as a kerchief by the carriers, they cooperate to enable or exert a retaining or anti-shifting effect and to keep the item in a desired disposition relative to the article and from unwanted contact with the wearer's skin.

4 Claims, 1 Drawing Sheet

APPAREL WITH CARRIERS FOR NECK-WEAR

BACKGROUND OF THE INVENTION

1. Field of the Invention

This invention is in the apparel field. It concerns articles of body apparel, such as shirts and blouses, which have neck openings as defined by a feature such as a neckband (but otherwise may be collarless) and carrier-loops in peripheral disposition near and with reference to the feature. The loops may engage or receive an item of elongate neck-wear, such as a neck-tie, or other adornment.

2. Description of Related Art

The related art includes the disclosures of these two U.S. patents: No. 2,903,703, for a shirt collar with slits through which a neck-tie is passed, and No. 4,599,750, showing a loop-like fabric strip on a trouser leg which functions as a hand-hold.

The related art also includes V-necked jumper garments, adapted to be worn with a neckerchief, which feature a short transverse loop or strip below the "V" of the neck onto which the neckerchief may be knotted or through which it may be tucked. The white jumper of the U.S. Navy enlisted men's uniform is an example of such a garment.

SUMMARY OF THE INVENTION

The objects of this invention are to provide (i) an article of wearing apparel, which does not have a fold-over collar or is collarless, with carrier-loops do obviate unwanted contact between the wear's neck and neck-wear or other neck-borne adornment, and (ii) a garment with means to assure appropriate and attractive disposition, relative to the garment and the wearer, of concurrently-worn neck-wear.

In and for purposes of this specification, the phrase "neck-wear" is defined to mean an elongate item of apparel or personal adornment which is discrete of any other apparel article, is flexible or pliant, and, as worn, is proximate and, typically, encircles (in a range from loose to relatively close) or depends from the wearer's neck, and to include items such as ascots, bandanas, bolo-ties, bow-ties, cravats, neckerchiefs, necklaces and other neck-jewelry, novelty items (such as miniature belts), scarves and string-ties.

An example of wearing apparel of the present invention is a T-shirt. A T-shirt has a neckband but, otherwise, is essentially collarless. Heretofore—notwithstanding the attractive contribution neck-wear items might confer—such items have been perceived as incompatible with, and seldom, if ever, worn on or in connection with T-shirts or other merely neck-banded clothing.

Such longstanding incompatability is based on several reasons. With apparel having only a neckband and no real collar, neck-wear is apt to shift or become mispositioned, and so negate the attractiveness it might otherwise afford. Secondly, absent a collar, a necklace or other neck-wear must bear on or depend from the wear's bare neck, and create an overly informal or graceless impression. Also, the neck-wear may chafe or cause other physical discomfort.

This invention overcomes such incompatibility by providing, on and for a garment, spaced loops or carriers in a course that corresponds with, is circumferential of, and is outward of the periphery of a garment's neckline. After an item of neck-wear has been passed through the carriers, they cooperate in the carriage thereof, and correlative operative effects, such as friction or catenation, keep the item from shifting or inappropriate positioning, and in suitable or desired coordination and other elements of the wearer's dress or costume. The neck-wear is also maintained on or in contact with the garment itself, thus dispensing with the problem of unwanted skin contact as well as any unduly information impression.

The apparel of this invention may, in one sense, be adapted to serve a dual purpose. Accordingly, where the carriers and the garment are fabricated of the same material and in the same color, the carriers may be effectively imperceptible, and the wearer may optionally wear the garment without adornment (and with the carriers empty) to express the same informal mode as if there were no carriers. Alternatively, when the wearer so desires, she/he may use the same garment with neck-wear to reflect a distinct, dressier mode.

DESCRIPTION OF PREFERRED EMBODIMENTS

Figure 1:
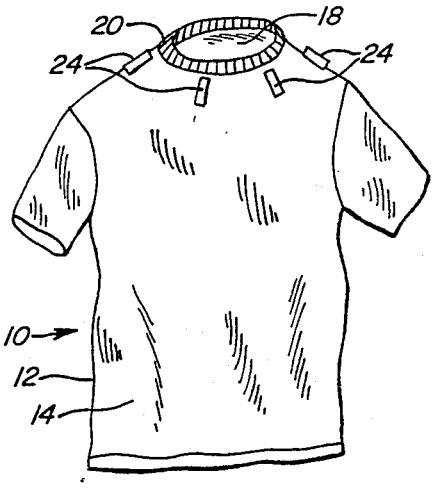
FIG. 1 is a front elevational view of one article of apparel of this invention. Gradually, and apart from the carriers of this invention, the article is of the type commonly known as a T-shirt.

FIGS. 1–4 generally depict a preferred embodiment of an article of apparel or garment of this invention; in these figures, reference numerals identify parts of the embodiment, as follows: 10 is a shirt such as a T-shirt, 12 is the body portion of shirt 10, 14 is the front of body 12, 16 is the back of body 12, 18 is the neck opening of shirt 10, 20 is the neckline portion or neckband of shirt 10, and 24 is each of several strips comprising carrier loops on shirt 10.

Also, in FIG. 4, numerals identify further aspect of this invention, as follows: 22 is the outer periphery of portion 20, 26 is the proximal (relative to opening 18) end-portion of a strip 24, 28 is the distal end-portion of a strip 24, and 30 represents stitching, at the respective distal portions 28 and proximal portions 26 thereof, by which the strips 24 are attached to body 12.

Figure 2:
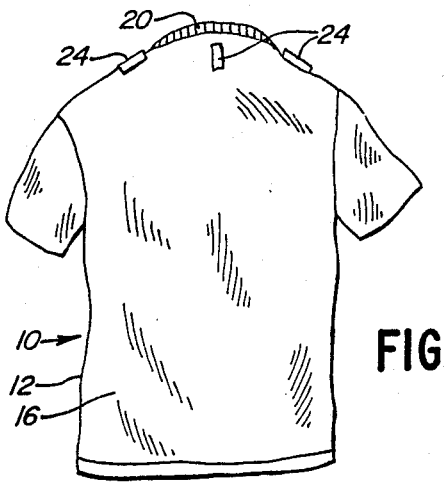
FIG. 2 is a back elevational view of the shirt of FIG. 1.
Figure 3:
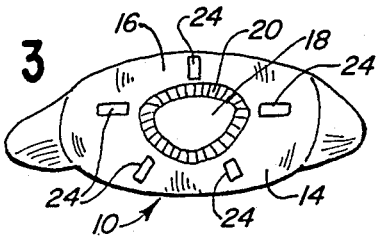
FIG. 3 is a top or plan view of the shirt of FIG. 1. The shirt is shown in a "filled out" condition, as if it is being worn.
Figure 5:
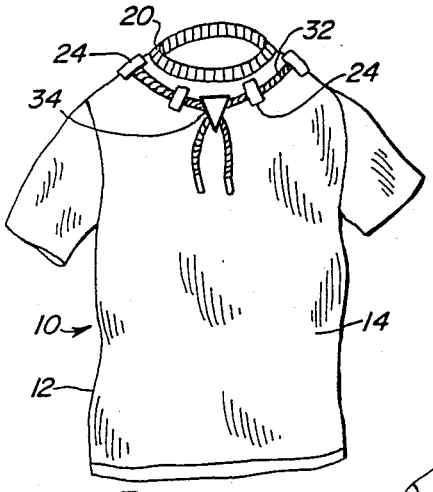
FIG. 5 is a front view of the T-shirt of FIG. 1, but also including, in the carriers and as exemplary neck-wear that may be carried by and worn with the shirt, a bolo-tie.
Figure 6:
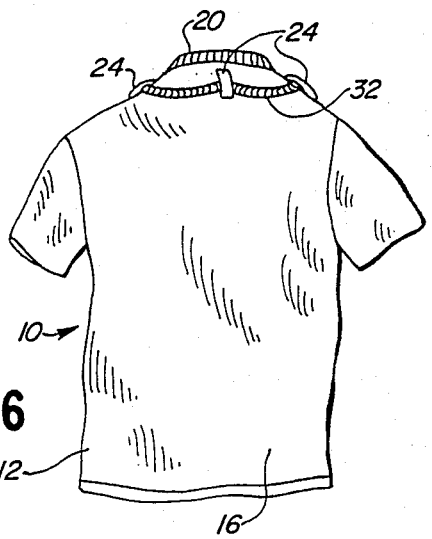
FIG. 6 is a rear view, corresponding to the front view of FIG. 5, of the shirt and bolo-tie of FIG. 5.

FIGS. 5 and 6 show substantially the same shirt as FIGS. 1–3, but with the shirt carrying a discrete exemplary item of neck-wear; numerals are the same as in FIGS. 1–3 and, also, 32 is a bolo-tie and 34 is the slide of tie 32.

Figure 7:
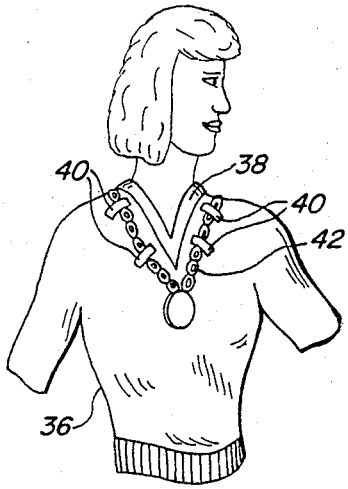
FIG. 7 is a sketch of another exemplary preferred embodiment. The embodiment is a V-neck blouse including a necklace, another type of item of adornment that may be associated with the invention.

FIG. 7 shows another embodiment of apparel of the invention; the apparel is a V-necked blouse, and numerals identify the blouse and related items, as follows: 36 is the blouse, 38 is the neckline margin of blouse 36, 40 is each of several carrier-loops on blouse 36, and 42 is a necklace.

The preferred embodiments are described and further disclosed from these standpoints; essential features, materials from the embodiments may be made, and other pertinent characteristics and features.

Figure 4:
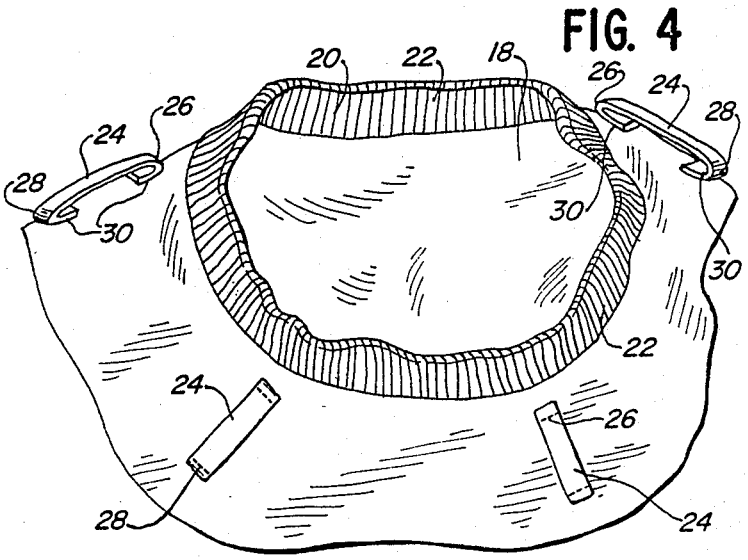
FIG. 4 is a front view of the neckband portion of the shirt of FIG. 1, but in greater detail than FIG. 1.

Concerning essential features of the present invention, the loop-like carriers as provided by strips 24 of shirt 10 in FIGS. 1–6 and carrier-loops 40 on blouse 36 in FIG. 7, or equivalent elements, are essential to all embodiments of the invention. The carriers define a circumferential course around the neckline periphery, the neck opening of a garment, and the wearer's neck, in the manner of loops 24 on and opening 18 of shirt 10 in FIG. 3, and, likewise, as in the sketch of FIG. 7. The length of the course corresponds to at least a portion of the length of a neck-wear item. Typically, as with the disclosed strips 24, the carriers are elongate members, and of substantially equal size. They complete a plurality of loops or pass-throughs wherein an item of neck-wear may be inserted and drawn along the course, and then tied, clasped, or otherwise conventionally completed. For example, movement of slide 32 of bolo-tie 30 up and into place, as suggested in FIG. 4, represents such completion.

When the neck-wear item is so completed and then disposed according to the wearer's preference, the carriers cooperatively function to retain it in the preferred disposition. This general retaining or anti-shifting effect may have a single or several components. One such is the primary frictional effect which occurs through contact between the apparel article and the neck-wear item. Although such contact may be small at individual points of the neckline-around course, when as the carriers define the course and thus assure the contact over at least a substantial portion thereof, the small individual contacts become effectively cumulative. A second, separate component obtains with reference to relatively loose-fitting flexible neck-wear items because the carriers enable and support disposition-stabilizing catenations in such items; the shallow catenaries of bolo-tie 32 in FIG. 6 illustrate this second component. Thirdly, there may be an ancillary frictional effect operative between the neck-wear and the carriers themselves.

In the preferred embodiments the number and arrangement of carrier-elements should optimize or enhance the described retaining or antishift effect and components thereof. The number of carriers must suffice clearly to define the neckline-around course aand to keep a carried item on the course and on the apparel. However, there should not be so many carriers as to preclude useful catenation or good economy of materials. In many embodiments, five carriers is a suitable number.

Various effective and convenient arrangements of the carriers are available. For example, the carriers may be substantially normal to the neckline, as in FIG. 3, the strips 24 are to neckband 20; spaced from each other at equal or approximately distances; and, in front-to-back orientation of the garment, generally symmetric. Again, the carriers in a particular arrangement may advantageously enable catenation of flexible items, as in FIG. 3. The carriers' proximal end-portions may be relatively close to, but, in any case, at least slightly spaced from the neckline's inner edge so that may keep a carried item from skin contact.

The size of particular carriers ought to be functionally consistent with their number and arrangement, and, relative to the widths of neck-wear likely to be inserted in them, dimensionally accommodate a variety of such items. FIGS. 5 and 6 show the loops comprising strips 24 with a lengthwise dimension notably greater than the width of the string of tie 32, and with the strips, themselves, being relatively narrow.

Concerning the materials from which preferred embodiments may be fabricated, various materials are suitable for the herein-disclosed apparel articles. An article such as shirt 10 or blouse 36 is of a pliant or non-rigid cloth such as cotton, synthetic fibers, wool, or combinations thereof. Carriers such as strips 24 may be of the same cloth, or of other suitable material or fabrication, such as metallic D-rings. The strips may be stitched to the article, as by stitching 28 in FIG. 4; alternatively, the carrier members may be otherwise attached, as by rivets or staples. As already noted, where an article and its strips are of the same color, the article is well suited to be worn in distinct informal and dressy modes.

Concerning other characteristics and features of the preferred embodiments, neckband 20 of shirt 10, is a woven neckband that is stretchable, resilient and flexile to accommodate the prospect that the wearer's head is larger than unstretched opening 18. The neckband of shirt 10 in FIG. 1 is separately provided and sewn onto body 12, but equally acceptable would be that the neckband or similar feature is integral with the shirt. In any case, the neckline portion has an edge or border in the nature of periphery 22 in FIG. 4 and the width thereof should be greater than merely nominal. Neckband 20 may serve as a guide for the outward spacing the carriers.

In the body 12 of shirt 10, front 14 and back 16 may be integrally formed or separate pieces sewn together. The body portion may be colored or dyed, and decorated to accent, complement or otherwise notably coordinate with one or more neck-wear items. The carrier-loops may be colored or dyed to contrast with the shirt.

An exemplary commercial embodiment of shirt 10 has these dimensions and other characteristics: body 12, neckband 20 and strips 24 are made of the same dyeable knitted cotton fabric; neckband 20 originates as a separate piece which is then sewn onto body 12; the maximum (unstretched) dimension of opening 18, across neckband 20, is slightly more than 5 inches; the width of neckband 20 (or the neckline periphery) is 1 inch; five strips 24 are provided in a symmetric arrangement as illustrated in FIG. 3; and, each strip 24 has an effective length of approximately 1 inch (thus to receive elongate neck-wear items whereof the widths do not exceed that dimension), and is about ½ inch wide.

Many other specific embodiments are within the spirit and scope of the present invention.

What is claimed is:

1. An article of collarless body apparel, which has a neck opening and may be worn with a discrete elongate neck-wear item, the said article comprising in combination a body portion of a pliant material and having a front and a back;

a neckband defining the neck opening and being, in front-to-back orientation of the article, symmetrical; and, a plurality of spaced elongate loop-like carrier elements on the body portion proximate the neckband and adapted optionally to receive and to cooperate in carrying a said neck-wear item;

whereon the carrier elements are symmetrically disposed relative to and define a course circumferential of the neckband; the course has a length generally corresponding to at least a portion of the length of said neck-wear item; each carrier element comprises a strip; the neckband and the strips are of the same pliant material as the body portion; the strips are of substantially equal length; and, each strip is generally normal to the neckband, has relative to the neckband a proximal end-portion and a distal end-portion, and is attached to the body portion by stitching at the proximal end-portion and at the distal end-portion.

2. An article of body apparel which has a neck opening and comprises in combination a pliant body portion;

a stretchable neckband defining the neck opening;

a plurality of carriers whereof each carrier comprises a strip and whereof each strip is proximate and generally normal to the neckband, has relative to the neckband a proximal end-portion and a distal end-portion, is attached to the body portion at the proximal end-portion and at the distal end-portion, and is spaced from adjacent ones of the carriers; and, a discrete elongate item of adornment;

whereon the item of adornment is received within and carried by at least some of the carriers.

3. The article of claim 2 wherein the carriers and the body are of the same material, the carriers are proximate and symmetrically disposed relative to the neckband, and each strip is attached to the body portion by stitching.

4. An article of body apparel for carrying a discrete elongate item of adornment and which a neck opening and comprises in combination a pliant body portion, a stretchable neckband defining the neck opening, a plurality of carriers whereof each carrier comprises a strip and whereof each strip is proximate and generally normal to the neckband, has relative to the neckband a proximal end-portion and a distal end-portion;

is attached to the body portion at the proximal end-portion and at the distal end-portion; and is spaced from adjacent ones of the carriers;

whereon at least some of the carriers are adapted optionally to receive and to cooperate in carrying a said item of adornment.

* * * * *